United States Patent [19]

Miller

[11] Patent Number: 4,472,878

[45] Date of Patent: Sep. 25, 1984

[54] HAIR CUTTING DEVICE

[76] Inventor: Jess Miller, Rt. 13, Box 183-B, Fort Worth, Tex. 76119

[21] Appl. No.: 462,871

[22] Filed: Feb. 1, 1983

[51] Int. Cl.[3] ..... B26B 19/00

[52] U.S. Cl. ..... 30/201; 30/196; 30/200; 30/233

[58] Field of Search ..... 30/196, 200, 201, 202, 30/213, 214, 233

[56] References Cited

U.S. PATENT DOCUMENTS

| | | | |
|---|---|---|---|
| 238,353 | 3/1881 | Coates | 30/201 |
| 592,770 | 11/1897 | Faracchio | 30/201 X |
| 614,960 | 11/1898 | King | 30/202 |
| 736,198 | 8/1903 | Black | 30/201 X |
| 818,462 | 4/1906 | McNally | 30/202 |
| 850,656 | 4/1907 | Klein | 30/201 |
| 1,615,328 | 1/1927 | Fewins | 30/201 X |
| 1,982,979 | 12/1934 | Buller | 30/202 X |
| 3,208,143 | 9/1965 | Suozzi | 30/201 |
| 3,648,370 | 3/1972 | Cercone | 30/201 |

FOREIGN PATENT DOCUMENTS

| | | | |
|---|---|---|---|
| 470375 | 12/1928 | Fed. Rep. of Germany | 30/201 |
| 475594 | 2/1929 | Fed. Rep. of Germany | 30/201 |

*Primary Examiner*—E. R. Kazenske
*Assistant Examiner*—Willmon Fridie, Jr.
*Attorney, Agent, or Firm*—Wm. T. Wofford; James C. Fails; Arthur F. Zobal

[57] ABSTRACT

A manually operated hair cutting device having a movable spring wire extending through the device. The wire has a base end for engaging one's head to regulate the length at which the hair is cut. The other end of the wire is connected to an activator which is adapted to be moved to forward and rear positions. As the activator is moved forward, the wire is moved through the device such that its base end is moved away from the cutting teeth. When the base end of the wire engages the head, and the activator is moved forward, the device moves upward along the wire. A movable stop normally prevents the handles from being moved together to prevent hair cutting action. An adjustable engager on the activator engages the stop and moves it out of the way as the activator moved forward to allow the handles to be moved together for hair cutting purposes. The engager can be located at different positions on the activator to vary the position at which it will engage and move the stop out of the way thereby allowing one to adjust the length at which the hair is cut.

10 Claims, 7 Drawing Figures

FIG. 1
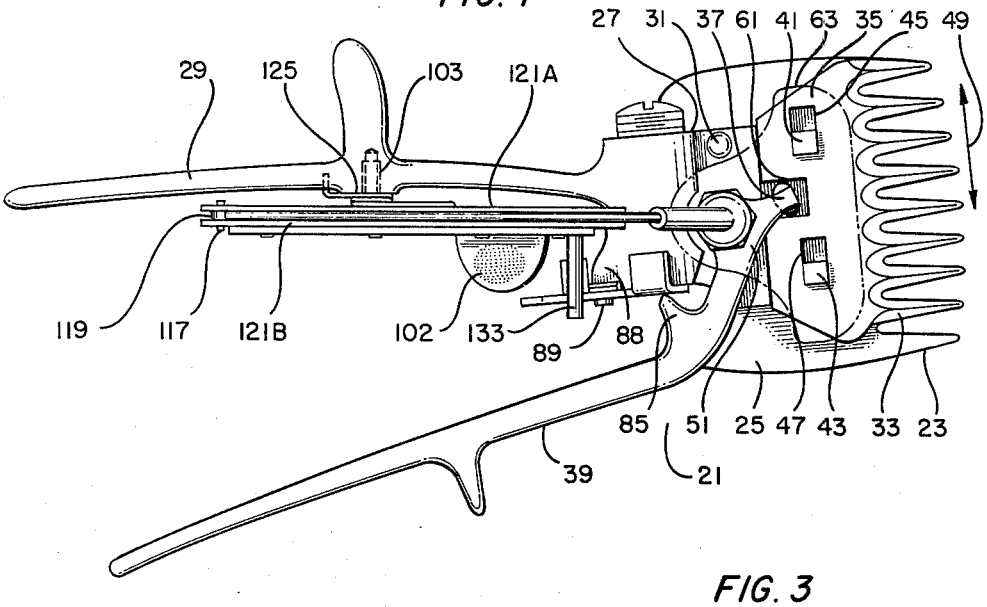
FIG. 3
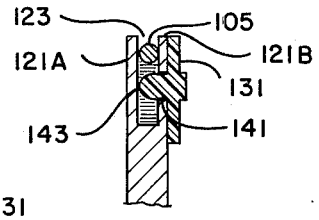
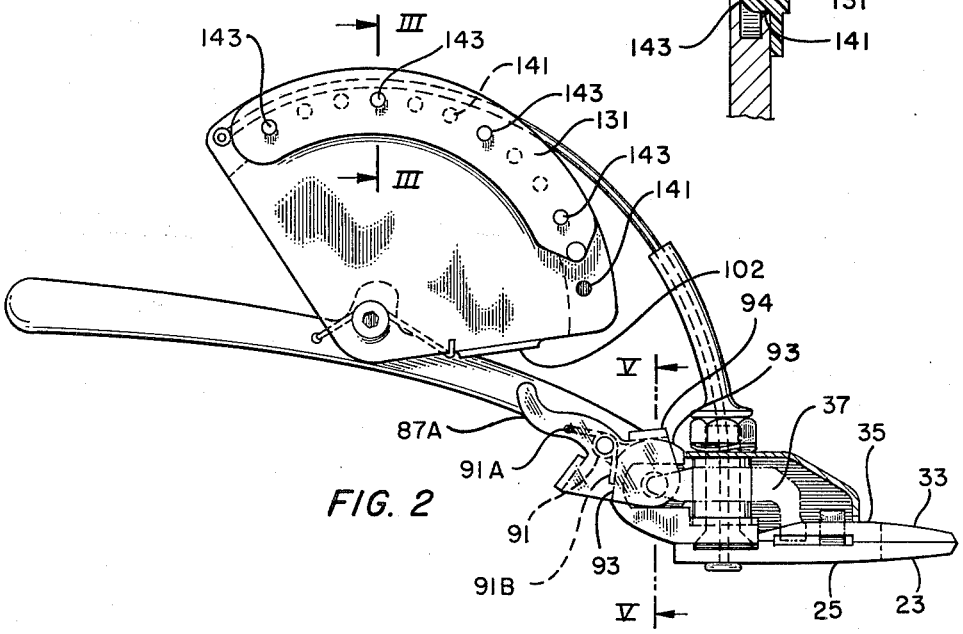
FIG. 2

FIG. 4
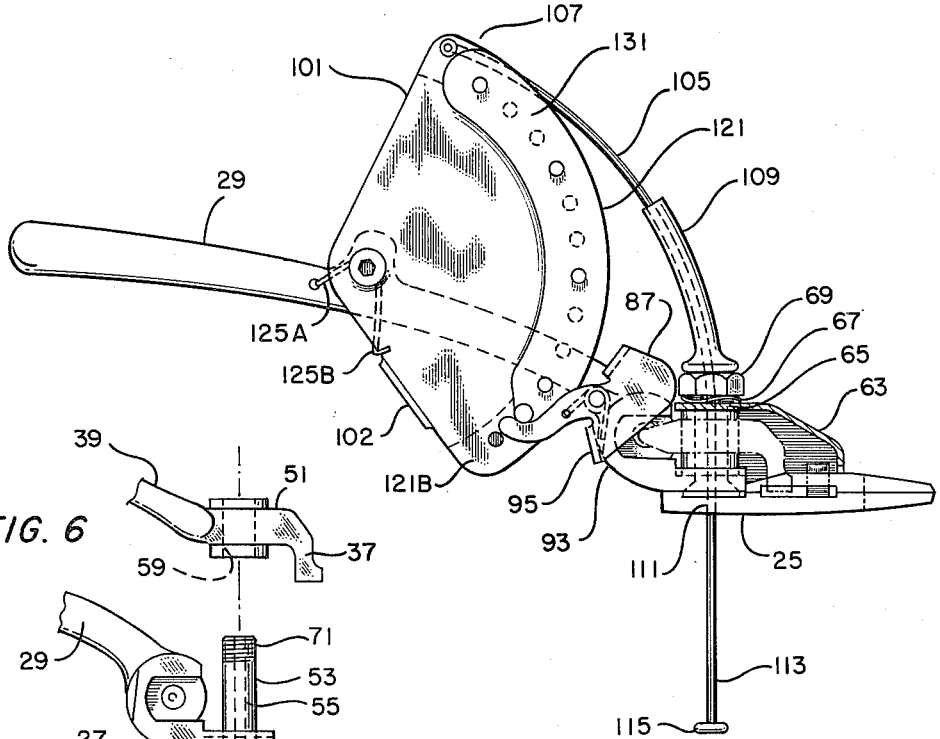
FIG. 6
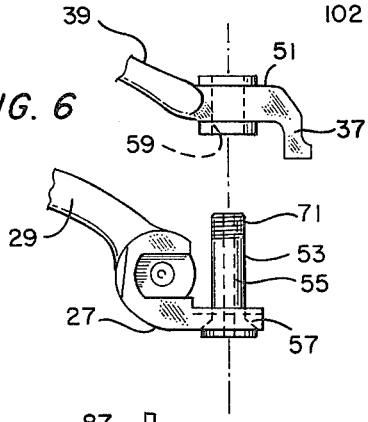
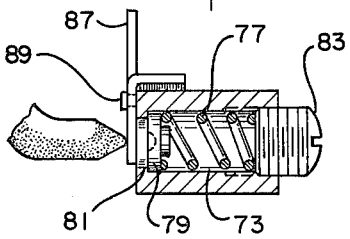
FIG. 5
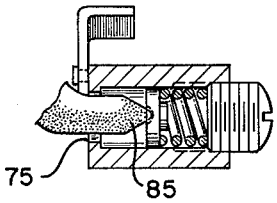
FIG. 5a

HAIR CUTTING DEVICE

BACKGROUND OF THE INVENTION

FIELD OF THE INVENTION

The present invention is directed to a hair cutting device having means to regulate the length at which the hair is cut.

DESCRIPTION OF THE PRIOR ART

U.S. Pat. Nos. 238,353, 736,198, 1,615,328, 3,208,143, and 3,648,370 disclose different types of hair cutting devices, some of which have means for regulating the length at which the hair is cut.

SUMMARY OF THE INVENTION

It is an object of the present invention to provide a hair cutting device having novel means for regulating the length at which the hair is cut.

It is another object of the present invention to provide a hair cutting device having novel means for allowing one to cut hair at the same length.

The hair cutting device comprises a first set of cutting teeth coupled to a handle and a second set of cutting teeth coupled to a handle. Means is provided for allowing one of said sets of cutting teeth to be moved back and forth relative to the other of said sets of cutting teeth for hair cutting purposes. Coupling means pivotally couples the handles together to allow the handles to be pivotally moved toward and away from each other for causing said one set of cutting teeth to be moved back and forth relative to said other set of cutting teeth for hair cutting purposes. Wire means extending through said coupling means has a base end for engaging one's head to regulate the length at which the hair is cut. The other end of the wire means is connected to an activating means which is adapted to be moved to forward and rear positions. As the activating means is moved forward, the distance between the base end of the wire means and the cutting teeth increases. A movable stop normally prevents the handles from being moved together to prevent hair cutting action. An adjustable engaging means on the activating means engages the stop and moves it out of the way as the activating means is moved forward to allow the handles to be moved together for hair cutting purposes. The engaging means can be located at different positions on the activating means to vary the position at which it will engage and move the stop out of the way thereby allowing one to adjust the length at which the hair is cut.

BRIEF DESCRIPTION OF THE DRAWINGS

FIG. 1 is a top plan view of the hair cutting device of the present invention.

FIG. 2 is a partial cross-sectional side view of the device of FIG. 1 with its movable stop located to prevent hair cutting action.

FIG. 3 is a cross section of FIG. 2 taken along the lines 3—3 thereof.

FIG. 4 is a partial cross-sectional side view of the hair cutting device of FIG. 1 with its movable stop located to allow hair cutting action.

FIG. 5 is a cross section of FIG. 2 taken along the lines 5—5 thereof.

FIG. 5A is another view of FIG. 5 with the movable stop of the device located in a position to allow hair cutting action.

FIG. 6 is a partial exploded view of the device of the present invention showing the pivotal connection between the two handles.

DESCRIPTION OF THE PREFERRED EMBODIMENT

Referring now to the drawings, the hair cutting device of the present invention is identified at 21. It comprises a lower set of cutting teeth 23 extending from a base plate 25 which is connected to the base 27 of a handle 29. Connection is by way of two bolts, one of which is shown at 31. An upper set of cutting teeth 33 has a base plate 35 coupled to an end portion 37 of a handle 39. In FIGS. 2 and 4, the end portion 37 of handle 39 is shown in phantom and the handle 39 is not shown. The base plate 25 has two members 41 and 43 extending upward from the top side thereof. Members 41 and 43 are square in cross-section. The base plate 35 has two rectangularly shaped apertures 45 and 47 formed therethrough for receiving members 41 and 43. Base plate 35 and its teeth 33 can slide back and forth on base plate 25 and its teeth 23, respectively, in the direction of the arrows 49 for hair cutting purposes. Members 41 and 43 along with apertures 45 and 47 limit the amount of back and forth movement of the base member 35 and teeth 33 relative to base member 25 and teeth 23.

The base portions 27 and 51 of handles 29 and 39, respectively, are pivotally coupled together by a cylindrical shaped member 53 having a central aperture 55 formed therethrough. Member 53 extends through an aperture 57 formed through the base portion 27 of the handle 29 and is fixedly connected to the base portion 27. Member 53 extends through an aperture 59 formed through base member 51 of handle 39 such that the handle 39 can pivot relative to handle 29. Base plate 35 has a rectangular slot 61 formed through its rear end in which is located the end portion 37 of handle 39. The handles and cutting teeth are held in place by a cover plate 63 which has an aperture 65 for receiving the member 53. Cover plate 63 is shown in phantom in FIG. 1. A lock washer 67 is located around the member 53 above the cover plate 63 and a nut 69 is screwed to threads 71 formed around the top of member 53 to hold the cover 63 in place. As the handles 29 and 39 are pivoted toward and away from each other, the end portion 37 of handle 39, located in slot 61, moves the plate 35 and teeth 33 back and forth relative to plate 25 and teeth 23 for cutting purposes.

The base 27 of handle 29 has a chamber 73 with an open end 75 facing the handle 39. A compression spring 77 and a disc shaped plate 79 are located in the chamber 73. Normally the spring 77 urges the plate 79 against a shoulder 81 at the open end 75 as shown in FIG. 5. The other end of the spring 77 seats against an adjusting tensioning member 83 screwed into the other end of the chamber 73. The handle 39 has a boss 85 located to enter the chamber 73 through its opened end 75 where it engages plate 79 and compresses the spring 77 as shown in FIG. 5A when the handles 29 and 39 are moved together. The spring 77 applies an outward force against the boss 85 such that when the handle 39 is released the spring 77 moves the boss 85 and hence the handle 39 away from handle 29.

A stop 87 is pivotally coupled to the front wall structure 88 of the chamber 73 by a pin 89. The stop 87 is adapted to pivot to a closed position as shown in FIGS. 2 and 5 and to an open position as shown in FIGS. 4 and 5A. In the closed position of the stop 87, the stop is located between the open end 75 of the chamber 73 and the boss 85. In this position of the stop 87, the boss 85 cannot enter the chamber 73 whereby the handles 29 and 39 cannot be moved toward each other thereby preventing cutting action by the teeth 23 and 33. In the open position of the stop 87, the stop is located away from the open end 75 of the chamber 73. In this position of the stop 87, the boss 85 can enter the chamber 73 whereby the handles 29 and 39 can be moved toward each other thereby allowing cutting action by the teeth 23 and 33. A coil spring 91 located around a pin 89, normally urges the stop 87 to its closed position. The spring 91 has one of its ends 91A connected to the stop 87 and its other end 91B engaging the side wall structure 93 of the chamber 73. Stop 87 has a tab 94 which engages the side wall structure 93 of the chamber 73 at the closed position of the stop 87 to limit movement of the stop 87 when it is moved to its closed position. This is shown in FIG. 2. Stop 87 also has a tab 95 which engages the side wall structure 93 of the chamber 73 at the open position of the stop 87 to limit movement of the stop 87 when it is moved to its open position as shown in FIG. 4.

An activating member 101 is pivotally coupled to handle 29 by a pin 103. Member 101 can be pivoted to a rear position as shown in FIG. 2 and to a forward position as shown in FIG. 4. A spring wire 105 has one end 107 connected to the member 101. The wire 107 extends through a curved tubular guide 109 connected to the nut 69, through aperture 55 of member 53 and through an aperture 111 formed through plate 25 such that the wire 105 may be moved through the cutting device. The other end 113 of the wire 105 extends beyond plate 25 and has a round base member 115 secured thereto, for example, by a threaded connection. The end 107 of the wire 105 is pivotally connected to the member 101 by a pin 117 which extends through member 101 and through a member 119 connected to the end 107 of the wire 105. Member 101 has an arcuate edge 121 with a slot 123 formed therein which acts as a guide for the wire 105. A coil spring 125 normally urges the member 101 to its rear position. The coil spring 125 is located around the pin 103 and has one of its ends 125A attached to the handle 29 and its other end 125B engaging the member 101.

When the activating member 101 is located at its rear position, the base member 115 of wire 105 is located next to plate 25 of teeth 23 as shown in FIG. 2. When the activating member 101 is moved to its forward position, the wire 105 is moved through the cutting device such that its base end 115 moves away from the lower plate 125 as shown in FIG. 4. A finger tab 102 attached to the member 101 allows the operator to move the member 101 toward its forward position with his finger.

A flat arcuate shaped member 131 adjustably attached to member 101 has a boss 133 extending therefrom for engaging the end 87A of the stop 87 and moving the stop to its open position as the member 101 is moved to its forward position. When this occurs, the base 115 of wire 113 will have moved away from the bottom plate 25 a certain distance and the handles 29 and 39 can be moved together to cause the teeth 23 and 33 to cut hair.

In use, the activating member 101 will be located at its rear position such that the base member 115 of wire 113 is against the bottom of the lower plate 25. The handles 29 and 39 will be located apart from each other such that the teeth 23 and 33 are in alignment as seen in FIG. 3. The operator will hold the handles 29 and 39 with his hand and locate the device 21 such that the base member 115 of wire 105 engages the person's head, whose hair is to be cut, and the lower side of the teeth 23 engages the head with hair located between the teeth 23 and 33. The operator then will engage the tab 102 with his finger and move the activating member 101 forward. When this occurs, the device 21 will rise above the head along the wire 105 providing a combing action with the aligned teeth 23 and 25. When the boss 133 engages and moves the stop 87 to its open position, the operator then can move the handles 29 and 33 together to cut the hair between the teeth. The tab 102 will be released to allow the spring 125 to move the activating member 101 to its rearward position moving the base 115 of the wire 105 against the bottom plate 25. The operator will release the handle 39 allowing the spring 77 to move the handles 29 and 39 apart. The spring 91 will return the stop 87 to its closed position. The cycle then will be repeated. For a given position of the member 131 relative to member 101, the length of hair cut will be the same for each cycle, since the base 115 of the wire 105 will be moved the same distance from the plate 25 when the stop 87 is opened.

By attaching the member 131 to different positions on the member 101, the distance that the wire 105 will extend beyond the lower plate 25 when the stop 87 is opened can be varied thereby varying the length at which the hair can be cut. In FIGS. 2 and 4, the member 131 is attached to member 101 at a position such that the wire 105 will extend a maximum distance below the lower plate 25 when the stop 87 is opened. The distance can be shortened by attaching the member 131 to member 101 at a more clockwise position than that shown in FIGS. 2 and 4. As seen in FIGS. 1–4, the edge 121 of member 101 comprises two spaced apart side wall portions 121A and 121B defining the slot 123. Side wall portion 121B has a plurality of equally spaced apertures 141 formed therethrough. In the embodiment shown, there are twelve apertures 141. Member 131 has a plurality of equally spaced apart prongs 143 formed on one side which are adapted to snap into the apertures 141 to attach member 131 to member 101. In the embodiment shown, there are four prongs 143. The member 131 can be removed from member 101 by removing the prongs 143 from the apertures 141. Member 131 then can be reattached to member 101 at a more clockwise position than that shown in FIGS. 2 and 4 by snapping the prongs 143 into the appropriate apertures 141 at the new position. When this is carried out, the boss 133 will be located closer to the stop 87 when the member 101 is at its rear position whereby the boss 133 will engage and move the stop 87 to its open position with less forward travel of member 101. This will result in wire 105 being extended a lesser distance below the lower plate 25 when the stop 87 is opened, thereby allowing the operator to shorten the length of the hair cut.

Although a snap-in arrangement is provided for adjusting the position of the member 131 and its boss 133 relative to member 101, it is to be understood that a different adjusting arrangement may be employed.

I claim:

1. A hair cutting device, comprising:

a first set of cutting teeth means coupled to a first handle, a second set of cutting teeth means coupled to a second handle, means for allowing one of said sets of cutting teeth means to be moved back and forth relative to the other of said sets of cutting teeth means for hair cutting purposes, coupling means for pivotally coupling said first and second handles together to allow said first and second handles to be pivotally moved toward and away from each other for causing said one set of cutting teeth means to be moved back and forth relative to said other set of cutting teeth means for hair cutting purposes, stop means supported for movement between a first position and a second position, in said first position, said stop means prevents said first and second handles from being moved toward each other whereby said first and second sets of cutting teeth means are prevented from cutting hair, in said second position, said stop means allows said first and second handles to be moved toward each other, activating means supported for movement between a forward position and a rear position, elongated flexible means extending through said coupling means for movement therein, said elongated flexible means having a first end connected to said activating means and a second end extending beyond said first and second sets of cutting teeth means such that when said activating means is moved toward said forward position, the distance between said second end of said elongated flexible means and said first and second sets of cutting teeth means increases and when said activating means is moved toward said rear position, the distance between said second end of said elongated flexible means and said first and second sets of cutting teeth means decreases, and engaging means coupled to said activating means for engaging said stop means and for moving said stop means to said second position as said activating means is moved toward said forward position to allow said first and second handles to be moved toward each other to allow said first and second sets of cutting teeth means to cut hair.

2. The hair cutting device of claim 1, comprising:

means for normally urging said stop means to said first position.

3. The hair cutting device of claim 1, wherein:

said engaging means may be adjusted to different positions on said activating means to vary the position at which said engaging means engages and moves said stop means to said second position as said activating means is moved toward said forward position.

4. The hair cutting device of claim 3, comprising:

means for normally urging said stop means to said first position.

5. A hair cutting device, comprising:

a first set of cutting teeth coupled to a first handle, a second set of cutting teeth means coupled to a second handle, means for allowing one of said sets of cutting teeth means to be moved back and forth relative to the other of said sets of cutting teeth for hair cutting purposes, coupling means for pivotally coupling said first and second handles together to allow said first and second handles to be pivotally moved toward and away from each other for causing said one set of cutting teeth means to be moved back and forth relative to said other set of cutting teeth means for hair cutting purposes, a boss extending from one of said handles toward the other of said handles for movement toward said other handle when said first and second handles are moved toward each other, stop means pivotally coupled to said other handle for movement between a first position and a second position, in said first position, said stop means prevents said boss from moving toward said other handle thereby preventing said first and second handles from being moved toward each other whereby said first and second sets of cutting teeth means are prevented from cutting hair, in said second position, said stop means allows said boss to move toward said other handle thereby allowing said first and second handles to be moved toward each other, means for normally urging said stop means to its first position, activating means pivotally coupled to said one handle for pivotal movement between a forward position and a rear position, elongated flexible means extending through said coupling means for movement therein, said elongated flexible means having a first end connected to said activating means and a second end extending beyond said first and second sets of cutting teeth means such that when said activating means is moved toward said forward position, the distance between said second end of said elongated flexible means and said first and second sets of cutting teeth means increases and when said activating means is moved toward said rear position, the distance between said second end of said elongated flexible means and said first and second sets of cutting teeth means decreases, and engaging means coupled to said activating means for engaging said stop means and for moving said stop means to said second position as said activating means is moved toward said forward position to allow said boss to move toward said other handle whereby said first and second handles may be moved toward each other to allow said first and second sets of cutting teeth means to cut hair.

6. The hair cutting device of claim 5, wherein:

said engaging means may be adjusted to different positions on said activating means to vary the position at which said engaging means engages and moves said stop means to said second position as said activating means is moved toward said forward position.

7. A hair cutting device, comprising:

lower cutting teeth means connected to a first handle, upper cutting teeth means coupled to a second handle, means for allowing said upper cutting teeth means to be moved back and forth relative to said lower cutting teeth means for hair cutting purposes, coupling means for pivotally coupling said first and second handles together to allow said first and second handles to be pivotally moved toward and away from each other for causing said upper cutting teeth means to be moved back and forth relative to said lower cutting teeth means for hair cutting purposes, a chamber carried by said first handle and having an open end facing said second handle, a boss extending from said second handle toward said first handle such that said boss may enter said chamber through said open end when said first and second handles are moved toward each other, spring means located in said chamber for applying an outward force against said boss when it enters said chamber, stop means pivotally coupled to said first handle for movement between a first position and a second position, in said first position, said stop means is located next to said open end of said chamber and prevents said boss from entering said chamber thereby preventing said first and second handles from being moved toward each other whereby said upper and lower cutting teeth are prevented from cutting hair, in said second position, said stop means is located away from said open end of said chamber whereby said boss may enter said chamber against the force of said spring means, means for normally urging said stop means to its first position, activating means pivotally coupled to said first handle for pivotal movement between a forward position and a rear position, wire means extending through said coupling means for movement therein, said wire means having a first end connected to said activating means and a second end extending beyond said lower cutting teeth means such that when said activating means is moved toward said forward position, the distance between said second end of said wire means and said lower cutting teeth means increases and when said activating means is moved to said rear position, the distance between said second end of said wire means and said lower cutting teeth means decreases, and engaging means coupled to said activating means for engaging said stop means and moving said stop means to said second position as said activating means is moved toward said forward position to allow said boss to enter said chamber whereby said first and second handles may be moved toward each other to allow said upper and lower cutting teeth means to cut hair.

8. The hair cutting device of claim 7, wherein:

said engaging means is removable from said activating means and may be coupled to said activating means at different positions to vary the position at which said engaging means engages and moves said stop means to said second position as said activating means is moved toward said forward position.

9. The hair cutting device of claim 8, comprising:

means for normally urging said activating means to said rear position.

10. The hair cutting device of claim 9, wherein:

said wire means comprises a spring wire means.

* * * * *